United States Patent [19]

Thompson

[11] Patent Number: 4,905,851

[45] Date of Patent: Mar. 6, 1990

[54] TAMPER EVIDENT CLOSURES AND PACKAGES WITH COLOR CHANGING MEANS AND SEPARABLE PORTIONS OF THE CLOSURES AND METHOD OF FORMING THE SAME

[75] Inventor: Mortimer S. Thompson, Arlington, Mass.

[73] Assignee: Tri-Tech Systems International, Inc., Maumee, Ohio

[21] Appl. No.: 292,661

[22] Filed: Dec. 30, 1988

Related U.S. Application Data

[63] Continuation of Ser. No. 177,842, Mar. 28, 1988, abandoned, which is a continuation of Ser. No. 936,989, Dec. 2, 1986, abandoned, which is a continuation of Ser. No. 834,499, Feb. 26, 1986, abandoned, which is a continuation of Ser. No. 726,953, Apr. 26, 1985, abandoned, which is a continuation of Ser. No. 609,742, May 14, 1984, abandoned, which is a continuation-in-part of Ser. No. 467,791, Feb. 18, 1983, Pat. No. 4,489,841.

[51] Int. Cl.[4] ..... B65D 55/02

[52] U.S. Cl. ..... 215/203; 215/230; 215/365

[58] Field of Search ..... 206/459, 807; 215/203, 215/230, 365

[56] References Cited

U.S. PATENT DOCUMENTS

| | | | |
|---|---|---|---|
| 2,201,205 | 5/1940 | Samburg | 215/230 |
| 2,939,597 | 6/1960 | Greene | 215/230 |
| 3,433,152 | 3/1968 | Mullen et al. | 101/28 |
| 3,468,744 | 9/1969 | Reinhart | 428/913 |
| 3,887,734 | 6/1975 | Chazan | 428/40 |
| 3,896,965 | 7/1975 | Cornell | 220/359 |
| 3,899,295 | 8/1975 | Halpern | 206/459 X |
| 3,923,198 | 12/1975 | Brochman | 220/359 |
| 3,935,960 | 2/1976 | Cornell | 220/260 |
| 3,984,005 | 10/1976 | Amberg | 215/230 |
| 4,423,822 | 1/1984 | Powalowski | 215/365 |
| 4,424,911 | 1/1984 | Resnick | 215/365 |
| 4,436,213 | 3/1984 | Paul et al. | 215/365 |
| 4,456,139 | 6/1984 | Kent | 215/230 X |
| 4,461,389 | 7/1984 | Korn | 215/246 |
| 4,489,841 | 12/1984 | Thompson | 215/203 |
| 4,579,240 | 4/1986 | Ou-Yang | 215/230 |
| 4,591,063 | 5/1986 | Sandhaus | 215/230 |
| 4,603,785 | 8/1986 | Gach | 215/230 |
| 4,666,052 | 5/1987 | Ou-Yang | 215/230 |
| 4,678,083 | 7/1987 | Anderson | 215/230 X |

*Primary Examiner*—Steven M. Pollard

*Attorney, Agent, or Firm*—Hedman, Gibson, Costigan & Hoare

[57] ABSTRACT

This invention relates to tamper evident closures and packages for indicating teh condition of the packages and particularly to caps for containers or bottles having a stretchable portion which can change color and a separable from the cap, all to provide a clear and unequivocal indicator of the condition of the container or bottle, e.g., that it has been opened or tampered with.

60 Claims, 7 Drawing Sheets

TAMPER EVIDENT CLOSURES AND PACKAGES WITH COLOR CHANGING MEANS AND SEPARABLE PORTIONS OF THE CLOSURES AND METHOD OF FORMING THE SAME

This application is a continuation of application Ser. No. 177,842, filed Mar. 28, 1988, now abandoned, which is a continuation of Ser. No. 936,989, filed Dec. 2, 1986, now abandoned, which is a continuation of Ser. No. 834,499, filed Feb. 26, 1986, now abandoned, which is a continuation of Ser. No. 726,953 filed Apr. 26, 1985, now abandoned, which is a continuation of Ser. No. 609,742, filed May 14, 1984, now abandoned, which is a continuation-in-part of application Ser. No. 467,791, filed Feb. 18, 1983, now U.S. Pat. No. 4,489,841, which is incorporated herein by reference.

FIELD OF THE INVENTION

This invention relates to tamper evident closures and packages for indicating the condition of the packages and particularly to caps for containers or bottles having a stretchable portion which can change color and a separable portion which can separate from the cap, all to provide a clear and unequivocal indicator of the condition of the container or bottle, e.g., that it has been opened or tampered with. The invention also relates to the method of forming the caps.

This application is a continuation application of copending application, Ser. No. 177,842, filed Mar. 28, 1988, now abandoned, which is a continuation of Ser. No. 834,499, filed Feb. 26, 1986, now abandoned, which is a continuation of Ser. No. 726,953, filed Apr. 26, 1985 now abandoned, which is a continuation of Ser. No. 609,742, filed May 14, 1984, now abandoned which is a continuation-in-part of Ser. No. 467,791, filed Feb. 18, 1983, now Pat. No. 4,489,841 which is incorporated

BACKGROUND OF THE INVENTION

The need for evidence of tampering with packaged products has been a perennial problem and with merchandizing activities more and more centered in large, unsupervised markets the need is greater than ever.

In general, commercially available tamper evident closures for capped container and bottle have not been satisfactory. They are costly, require additional packaging operations, compromise recycling, may be harmful and give ambiguous results. One or more of these drawbacks are present in currently available seals, bands and multicomponent or multifunctional caps.

One current method for producing such evidence in bottled products calls for the use of wafer-like seals under the cap, sealed to the bottle opening and barring access to the bottle contents until removed. Various methods of application and materials are used for a variety of products. Another method uses a plastic or metal band intimately covering the cap and adjacent neck to prevent access to the cap without removal of the band. Such methods are popularly used on bottles for wine and medicinal products. These wafer-like seals and external bands perform the task of producing evidence of tampering but only if the purchaser or user is familiar with the makeup and appearance of the unopened package because these items are separable from the primary package of cap and bottle and no explicit evidence remains. An additional handicap of such devices is the extra cost in materials, packaging machinery and the cost of operating such machinery.

Another method of providing tamper-evidence for bottles is to use caps with extended skirt portions which engage restraining features in the bottle neck and which must be gripped and torn away before the cap can be removed. This method suffers from the handicap that explicit evidence of tampering does not remain with the primary package. In other words, the torn-away lower cap portion is completely separated from the cap and container and is no longer present as a tamper indicator.

Other methods for producing tamper evidence in containers are accomplished using a perforated breakaway lower skirt portion of a metal or plastic cap on a threaded bottle neck engaged by the neck and broken away by normal cap removal procedure and retained on the bottle neck. This leaves the evidence of tampering on the package where, upon examination, it can be seen as a separated portion of the cap. However, metal caps leave a metal ring on the bottle neck which can have sharp edges and which also present a recycling problem for the bottle. Efforts to solve this problem have resulted in a metal cap with a lower skirt portion which splits radially to leave the cap in one piece when the bottle is opened. Unfortunately, solving the one problem has led to another which is the difficulty in determining whether the bottle has been opened since a careful examination is required, in most instances, to determine whether the skirt has split. Additionally, the effectiveness of the breakaway or split skirt in metal caps is a function of the control over the operation of forming the threads and breakaway feature. These are configured "in situ" on the bottle neck by a "roll-on" mechanism. Some incidence of faulty tamper evidence features are commonly known to occur during this operation which may lead to the erroneous conclusion that bottles have been tampered with.

Similarly, plastic caps with tamper indicating breakaway lower skirt portions also can falsely indicate tampering. For example, when the skirt portions are heat-shrunk in place in the capping operation ruptures can occur because of overheating. Further, the lower skirt portions commonly are connected to the cap proper with posts of small cross section spaced around the periphery of the cap which are stretched and broken during cap removal. These posts must be fragile enough to break during normal twist off procedures without requiring excessive removal torques. This presents a problem in withstanding stresses encountered during application of the cap to the bottle or by carrying in or removing from multipackage carriers which grip the bottle below the cap, and notwithstanding the fragile nature of the posts, they often cause undesirable levels of removal stress and torque. During cap removal each interconnecting post goes through a typical tensile stress failure with a consistent build up of stress level until a fracture occurs. All of the posts go through this process simultaneously so that the stress build up is additive and can be a significant factor in the removal torque of the cap.

In some cases, thin continuous webs or lines of fracture have been proposed instead of posts for the frangible interconnecting portion between separable lower and upper cap portions. Even when the webs are very thin, however, they require relatively large forces to rupture them. As a result, serrations with a number of slits have been proposed to reduce the removal force which, in turn, can lead to premature rupturing and a false indication of tampering.

Another problem associated with molding plastic caps having thin interconnecting posts or lines of fracture is the greatly restricted flow of plastic through such portions to the thick portion below which constitutes the interference and tamper evidence means. This restricted flow can lead to undesirable external sink marks, internal voids or poor knitting of the plastic at weld lines, all of which can deteriously affect cap performance. To minimize such problems the interconnecting portions are sometimes made thicker than otherwise necessary or, from the standpoint of cap removal torques, desirable.

In making the present invention, moreover, it has been observed that in plastic caps having separable portions, the interconnecting portions frequently have excessive elongation. This can cause loss of thread engagement during twist-off cap removal before the cap lower portion is separated from its upper threaded portion, thereby frustrating cap removal. To offset this problem, this may require an increase in thread length resulting in a deeper skirt and higher cap costs in addition to the inconvenience of increased cap rotation during removal and reclosing.

Furthermore, plastic caps having separable portions with interconnecting serrated webs or posts are relatively expensive to manufacture, requiring complex injection molds to produce the desired slits or gaps which define the posts or web portions. Molds for these caps have significant sideways acting elements which are costly, which are subject to excessive wear from sliding friction, and which increase molding cycles and reduce the maximum number of cavities feasible for molding. Also, mating mold portions of the thin mold configurations needed to form the thin slits or gaps have a tendency to break down under production conditions with the potential of seriously altering the slit or gap dimensions and introducing inconsistencies to cap performance. As an alternative, the slits in the cap can be formed after molding using special knife edge slitting machines, but this introduces a separate operation with additional cost and quality control problems.

Thus, known tamper evident closures and packages and techniques for forming the closure are beset with drawbacks.

SUMMARY OF THE INVENTION

In accordance with the present invention, there is provided a new and unique tamper evident closure and package which provides clear and unequivocal evidence of the condition of the package. The package preferably includes a resealable cap for closing, opening and reclosing a container, color changing means which changes color upon stretching, and separable portion on the cap which mechanically coacts with the container to stretch the color changing means to produce a change in color which indicates the condition of the package. Preferably, the color changing means is on the cap and changes color to indicate the condition of the package upon movement of the closure, e.g., in removing the cap to open the container.

In a preferred embodiment, the cap of the invention includes a top and a depending skirt which engages the finish of a container or bottle to seal the container and which has a breakaway portion e.g., ring or rim, to tensile stress at least a portion thereof to cause the desired color change. The breakaway portion can be tensile stressed by means thereon which engage the neck finish and produce an interference to removal of the cap. In overcoming the interference and separating the ring or rim from the cap, the color changing stress is developed and used to indicate a change in the condition of the package.

Where legends, or other well defined indicia, indicating opening is desired, the color changes can be localized in the skirt by providing thin sections which stretch preferentially and adjacent thicker sections which remain substantially unstretched. The thin sections for example can be a legend, or alternatively the thick sections can be the legend while the thin sections provide a suitable background.

To facilitate uniform stretching of the thin skirt sections judiciously located slots can be included which separate segments of the thick portions to provide complete mobility of the legend producing cap portion during stretching. For example, thick legend portions which form letters (or the spaces between letters) may be slotted in one or more places to facilitate stretching thin portions thereabout or therebetween providing a stenciled appearance. In another embodiment, the boundaries of thin letters which form a legend may be merged to form a contiguous stretchable legend outlined by a background and interspersed with letter portions which are thicker and do not stretch. In this instance, the contiguous portions distribute the color changing stresses throughout the legend without disrupting or distorting its legibility. Where desired, the thin legend sections can be shaped or slanted so that their boundaries with the thicker substantially stretched sections are on a bias with the direction of the applied stress, e.g., individual letters or indicia can be slanted or otherwise distorted from traditional, vertical, straight-edged shapes.

In a preferred embodiment for a threaded cap, mechanical engagement means between cap skirt and threaded bottle neck develops the needed stretching by translating a twisting motion into a tensile stress on the cap skirt in the area of the legend or indicia which is below the threads and above a projection which engages a ring or other projection on the bottle neck. The lower cap portion containing the projection can be separated from the upper portion of the cap containing the legend area by an interconnecting tearable portion having suitable tear initiators, such as opposing slits, so that when the separable lower cap portion engages the projection on the bottle neck upon cap removal an axial tensile stress occurs in the upper cap portion to cause a color change indication of opening in one portion of the periphery and to cause initiation of a tearing action in another portion of the periphery along the interconnecting portion where the tear initiators or slits are located. Subsequent propagation of the tear upon continued twist removal of the cap then results in a separation of the lower cap portion from the upper cap portion providing a further indication of opening. Locating the tear initiators or slits away from the legend producing area permits the concentration of the twist-off force to be primarily directed to stressing the legend area, thereby minimizing such removal forces. Employing a tear propagation mechanism for the interconnecting portion also minimizes removal force by balancing the increase in removal force as the rotation of the cap progresses with a decrease in the length of the stressed interconnecting portion as the tear progresses. In this manner the maximum level of removal torque is kept significantly below that level of torque which would be required to simultaneously stretch and finally rupture the entire interconnecting cap portion.

In the practice of the present invention, it is preferred that the interconnecting portions between the upper skirt and lower rim or ring have a breadth or circumferential length substantially equal to or greater than the corresponding breadth of the legend. Further, the interconnecting portion preferably is located directly under the legend. In other words, the stress producing interconnecting portion should be dimensionally sufficient and suitably located to effect the desired color change.

In another embodiment, the lower cap portion containing the interfering projection is connected to the top cap portion by a tearable portion without a slit. In this case, the interconnecting portion is of generally uniform thickness except for one or several thin sections spaced away from under the legend areas. When the cap is removed from its coacting bottle neck the thicker sections of the interconnecting portions will transmit significant stress to the legend portions creating the color change indication of opening while only nominal stresses will be generated at the thinner interconnecting portions thereby minimizing removal torques. A feature of this embodiment is that such caps can be produced at a particularly low cost with relatively simple and long-life molds having shorter molding cycles.

In a further embodiment of the invention, the cap interconnecting portion is of uniform thickness but its interfering projection has raised portions on its periphery which are first to engage the bottle neck interfering projection. In this manner, quite high stress levels can be developed in restricted segments of the cap periphery before significant stress levels are developed elsewhere. This mechanism can be employed in one embodiment to preferentially stretch a segment of the interconnecting cap portion to the point of rupture forming a slit (so that the tearing mechanism discussed above may be initiated and advantageously employed at lower removal torques) whereafter other portions of the periphery may be stressed in the same manner and sequence where tearable interconnecting portions with slits are used. This mechanism can be used in another embodiment to preferentially stretch certain segments to the point of rupture to initiate tear and simultaneously or sequentially stress other segments which are below the legend areas to impart color changing stress while the interconnecting cap portion lying between these locations remains relatively unstressed. In this manner, premature tearing of the interconnecting cap portion below the legend as a result of tear propagation is deferred until the legend area is sufficiently stressed to effect the desired color change. Removal torques are kept low by this arrangement and expensive tooling and secondary operations are not needed.

In another embodiment, the interconnecting cap portions lying between the legend locations and points of slit generation may have below it an interruption or gap in the cap interfering projection. In this manner, tear propagation through this location will be retarded but achievable at significantly lower stress because of the greatly increased leverage introduced. As the cap is twisted further during removal tear propagation will result from the interference which remains between cap and bottle neck at the location where the slit was generated and at significantly lower removal torques.

In another embodiment, the interfering cap projection is of uniform circumferential height and the coacting bottle neck projection has a downwardly directed localized protrusion which preferentially engages the upper surface of the cap projection so that a point-by-point development of axial stress is accomplished around the cap periphery as it is removed thereby minimizing the levels of torque needed to remove the cap while localizing stress development for breaking, tearing or color development purposes.

In still another embodiment, the lower cap portion includes an external rim having raised portions on its upper surface designed to be engaged by a bottle capping fixture which preferentially depresses the raised rim portions to initiate tearing and/or to cause a color change of the cap skirt while abutting and supporting the intermediate rim portions, thereby protecting thin interconnecting or other cap portions from compressive or other failure during initial capping of the bottle. In this manner a cap may be produced in inexpensive molds and a slit automatically created during the capping procedure at no extra cost, thereby initiating a tear while additionally or alternatively creating a legend such as "SEALED" on the cap skirt. Subsequent removal of the cap from the bottle neck alters the legend to "UNSEALED" by the appropriate engagement of the interfering projections of the cap and bottle neck while completing the tear separation of the lower cap portion from the upper cap portion at relatively low removal torques.

In another aspect of the invention, the plastic caps of the invention can be subjected for short periods to temperature conditions below those which would cause the unsupported caps to deform. It has been discovered that after molding the caps, such heat treatment generally enhances the levels of stress whitening achieved by plastics having this basic characteristic so that color contrast between stretched and unstretched cap portions may be improved or optimized.

In the practice of the invention, it also has been discovered that the thin interconnecting portions lying between the thicker skirt and the lower rim or ring portions can have an integrity in terms of elongation to break which is undesirably high. This causes problems in breaking the interconnecting portion before thread engagement between the cap and container neck is lost, thereby frustrating cap removal. Surprisingly, it has been found that heat treatment or annealing at appropriate conditions after molding the cap and prior to its application to the container significantly impairs the integrity of such interconnecting portions so that they may readily be ruptured thereby facilitating the practice of the tear initiating and tear propagating mechanisms and means of the invention. This finding is unexpected because heat treatment or annealing has typically been a recourse taken to enhance the integrity of molded plastic products wherein the integrity has been impaired as a result of molding conditions and/or the configuration of the molded part. Thus, such treatment can result in greatly facilitated cap removal at low removal torques by reducing the extensibility of the plastic cap interconnecting portions, thereby improving its tearability at low removal torques and reducing the amount of thread engagement required to separate the upper and lower cap portions.

In the invention, moreover, the color changing portion of the closure or cap can be an integral part thereof including all of it or it can be applied to the closure or cap surface as a coating, laminate or the like. In each embodiment, however, the color changing portion is a permanent part of the closure or cap. Also, the color changing portion can effect the legend directly or by providing a background for the legend which can be painted thereon or which can include thicker unstretchable portions therewithin.

In certain embodiments, the color change is used to create a legend such as the word "opened" on the bottle cap as it is removed from, or "sealed" as it is applied to the container. In other embodiments, the color change is used to change a legend, such as changing the word "unopened" to "opened" or "sealed" to "unsealed". Other legends and symbols can be created to practice the invention or the invention can be practiced by the creation of undefined areas of color change which do not depend on adjacent thick and thin sections.

The color changes employed by the invention preferably are accomplished by such basic phenomena as stress whitening inherent in various plastic materials. Alternatively, the color changes can be accomplished by mechanisms such as the use of encapsulated staining or coloring agents incorporated in a suitable matrix.

An important feature of the invention is that the proof of prior opening is very noticeable. Its prominent location on the skirt of the bottle cap itself, utilizing a pronounced contrast in color, provides graphic evidence of prior opening with the practice of the present invention.

Another feature of the invention is that the proof of prior opening can be very articulate, actually spelling out the word "opened" or its equivalent in various languages or symbols.

Correspondingly, the invention can be used to provide evidence that the container is closed by spelling out the words "sealed" or "unopened" or their equivalent.

Another important feature is that the primary evidence of prior opening remains as an integral part of the cap and is not torn off and thrown away. Also, the tamper evident feature of the invention is not dependent upon a prior awareness of the construction of the closure and what is the tamper evident feature.

Still another feature is that the cap of the invention is removed easily as a result of the progressive dissipation of removal stress in portions of the cap periphery while this stress is building up in other portions. The stress, therefore, does not build up to a high level followed by a sudden release as with roll-on metallic or other plastic caps with break away lower rings.

Another feature of the invention is a further indication of prior opening of a bottle by a lower cap portion which separates from the upper cap portion and is retained on the bottle neck.

Another aspect of the invention is its reliability in use by employing controlled dimensions and physical displacement of cap portions to create the cap separation and opening evidence using the close dimensional tolerances possible with molded plastic caps instead of the unreliability which can be introduced by roll-on metal or heat-shrink plastic break away rings.

In a further aspect of the invention, the interconnecting thin portion between the cap skirt and ring or rim can be provided by including an internal groove which is not externally visible. Accordingly, the skirt is flush and does not give any indication of the internal groove.

Still another feature of the invention is that it does not require new or unusual bottle neck designs but can employ existing bottle neck finishes. At the same time, the invention does not require new or unusual cap engagement means but can be practiced using traditional continuous or discontinuous threaded designs.

Still another feature of the invention is its versatility in that it may be used to package virtually the whole range of dry or liquid products from vacuum packed, long shelf life products to pressurized containers such as for soft drinks or beer.

Another important feature of the invention is that it is economical. The caps may be one piece with a design which conserves material and can be produced in low cost, high volume injection molding operations using low cost injection molds and short molding cycles. Also, no separate operations are required on the packaging line for its implementation.

Furthermore, the caps of the invention can be removed from and replaced on containers using normal uncapping and recapping procedures and may be applied to containers in product packaging operations using standard capping machines and technology.

Thus, the caps and containers of the invention are relatively inexpensive, they do not require additional packaging operations, they do not compromise recycling, they are not harmful, they are easy to remove and put on and they provide clear and unequivocal evidence of the condition of the package.

BRIEF DESCRIPTION OF THE DRAWINGS

The following is a detailed description together with accompanying drawings of illustrative embodiments of the invention. It is to be understood that the invention is capable of modification and variation apparent to those skilled in the art within the spirit and scope of the invention.

FIGS. 26–28 are longitudinal sectional views illustrating components of an injection mold of the invention for making the caps thereof, wherein FIG. 26 illustrates the formation of a cap in the mold, wherein FIG. 27 illustrates the removal of the cap from the mold cavity, and wherein FIG. 28 illustrates the removal of the cap from the core.

Referring now to FIGS. 1 to 10, there is shown a threaded cap 10 and a partially shown bottle 11 having a neck finish 12. The cap 10 includes a top or lid 14, a skirt 16 and a liner 18 (FIG. 10). Externally, the skirt 16 includes a rim 22 at its lower end. Internally, the skirt 16 includes threads 24, in its upper portion, opposing legends 26 between the rim 22 and the threads 24 created by the recesses 32 and the sidewalls 32*b*, which form contiguous thin sections 32*a* (see FIGS. 7 and 8), and an integral groove 13 which forms a thin interconnecting web 35 adjacent the rim 22. The external surface of the skirt 16 opposite each internal legend recess 32 and groove 13 is flush and gives no indication of the legend 26 and groove 13 which lie behind it. Under the legend 26 on the lower inside periphery of skirt 16 is an annular sill 34. The rim 22 includes an internal projection 36, in the form of a finite ledge. The thin interconnecting web portion 35 is interrupted in two opposing locations by tear propagators in the form of slits 33 for separating the rim 22 from the upper cap portions. The slits 33 are intermediate or between the legends 26 spaced about 90° therefrom. The bottle cap 10 is made from a plastic which stress opacifies or stress whitens at the legend portions 26 (e.g., polypropylene copolymer). The cap 26 is formed by molding and thereafter is heat conditioned or treated to a temperature of 320° F. for 5 minutes prior to application to the bottle 10.

Figure 1:
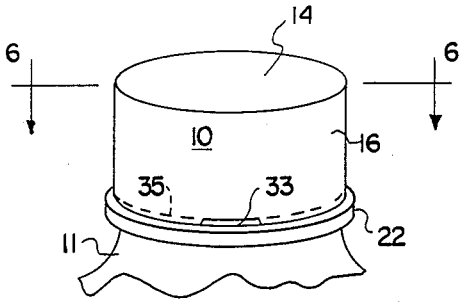
FIG. 1 is a perspective view of one embodiment of a twist cap and the upper portion of the bottle of the invention prior to the initial removal of the cap.

It is to be understood that unless otherwise specified, rim, ring and the like are used interchangably for the interconnecting portion 35 of the cap 10.

The neck finish 12 of the partially shown bottle 11 includes a lower external locking ring 42 and an upper external threaded portion 46 complimentary to the internal upper threads 24.

Figure 2:
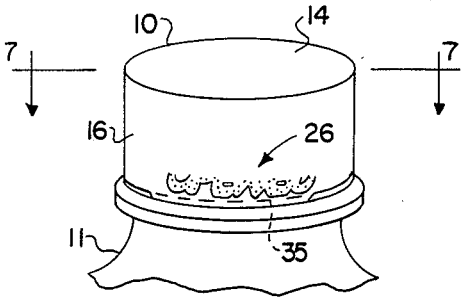
FIG. 2 is a perspective view of the and bottle of FIG. 1, wherein removal of the cap has been initiated and the legend to indicate the condition of the package is beginning to show.

In FIG. 1, the cap 10 is shown in engagement with bottle 11 before opening. Each legend 26 formed by the internal recess bottoms or thin sections 32*a* are invisible. In FIG. 2, the cap 10 has been rotated 90° in relation to bottle 11 to initiate cap removal. The legends 26 (one shown) formed by the internal recesss 32*a* are becoming visible on the outside surface of skirt 16 as the opacification or whitening of skirt 16 at the thin sections or recess bottoms 32*a* begins as a result of tensile stresses and the resultant strain created in the removal of the cap 10. Concurrently, the slits 33 have begun to propagate along the thin interconnecting portion 35 also as a result of the stresses created in cap removal.

Figure 3:
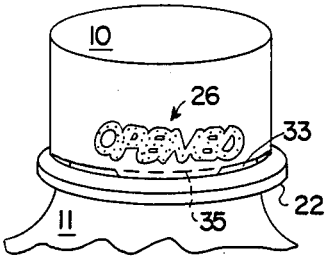
FIG. 3 is a perspective view of the cap and bottle of FIGS. 1 and 2, wherein removal of cap has progressed with the legend OPENED clearly shown and the breakaway portion or ring almost completely separated from the cap.

In FIG. 3, the cap has been rotated 270° during cap removal. The legends 26 (one shown) is now fully in evidence on the external surface of skirt 16 and the slits 33 have propagated to a point where the rim 22 is almost completely separated from cap 10.

Figure 4:
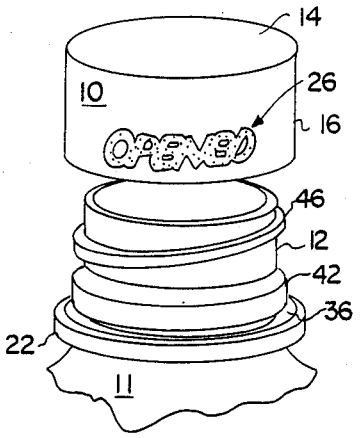
FIG. 4 is a another perspective view of the described cap and bottle, wherein the cap has been removed from the neck finish of the bottles while the breakaway portion or ring of the cap remains thereon.

In FIG. 4, the cap 10 has been separated from bottle neck 12 and from its lower rim portion 22 which is retained by the locking ring 42 of the neck 12.

Figure 5:
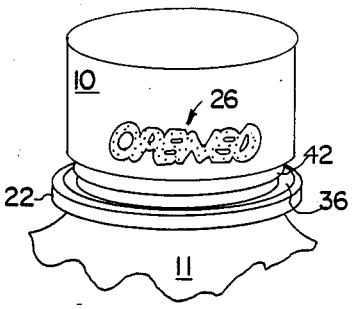
FIG. 5 is another perspective view of the cap and bottle, wherein the removed cap is screwed back onto the bottle.

In FIG. 5, the cap 10 has been reapplied to the bottle 11 with the legend 26 and separated rim 22 providing clear and articular evidence that the bottle has been previously opened.

In FIGS. 6 to 10, there is shown how the tensile stress noted above is created by the interference engagement of the internal projection 36 of the cap 10 with the external locking ring 42 of neck finish 12. The twisting action of removing cap 10 in a counterclockwise direction is translated into an axial tensile stress on the interconnecting portion 35 and therethrough to the skirt 16 in the area of the legends 26 by the described interference engagement. The recess bottoms 2*a* are thin enough (e.g., 0.005 to 0.010 inch) to yield under such stress, with the resultant strain causing whitening which is visible throughout the thin cross section. The contiguity of the thin portions 32a of the legends 26 permits all portions of the area of the legends 26 to stretch freely regardless of the shape of the legends by making it possible for thick sections 38 to move freely without whitening. The interconnecting portion 35 is thick enough to transmit the tensile stresses to the skirt 16 (e.g., 0.010 inch or greater) but thin enough to readily permit the tear propagation initiated by the slits 33 (e.g., less than 0.25 inch), and its thickness may be varied to optimally achieve these requirements. Correspondingly, the wall thickness of the skirt 16, typically can be from about 0.015 inch to about 0.050 inch. Generally, the cross-sectional area of interconnecting portions 35 at the internal groove 13 can be from about 0.2 to about 0.5 the cross section of its superior skirt portion and the groove 13 generally is U or V shaped. Also, the height of the fracture line or interconnecting portion 35 can be about 0.010 inches to about 0.030 inches. In addition to the interconnecting portion 35, the configuration and dimensions of projection 36 and those of the cap skirt 16 and the bottle locking ring 42 are such as to develop sufficient tensile strain to develop the desired color change in the legends 26 and tearing action along the interconnecting portion 35 while retaining the lower rim 22 securely on the bottle neck 12 at low removal torques. To achieve these objectives, the web 35 is thinner in cross-sectional area or dimension than the adjoining skirt 16 and rim or ring 22.

Figure 6:
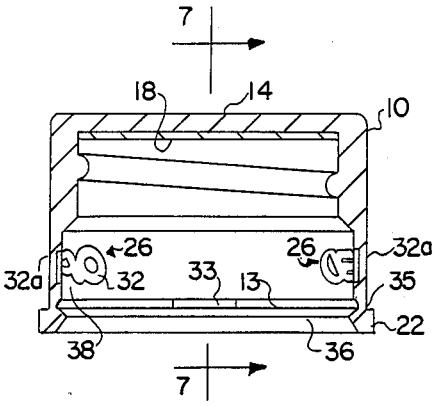
FIG. 6 is a longitudinal sectional view of the cap of FIG. 1.
Figure 8:
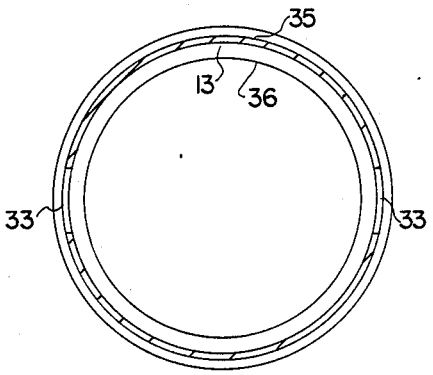
FIGS. 8 and 9 are cross-sectional views of the cap of FIG. 7, taken along the lines 8—8 and 9—9, respectively.
Figure 7:
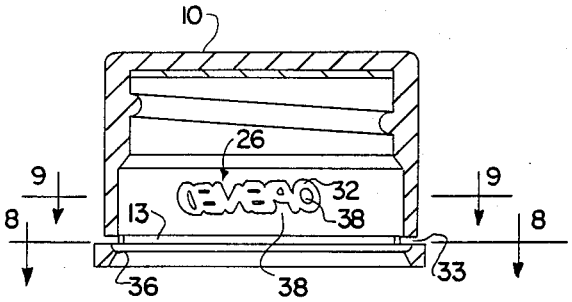
FIG. 7 is another longitudinal sectional view of the cap of FIG. 1 taken along the lines 7—7 of FIG. 6.
Figure 9:
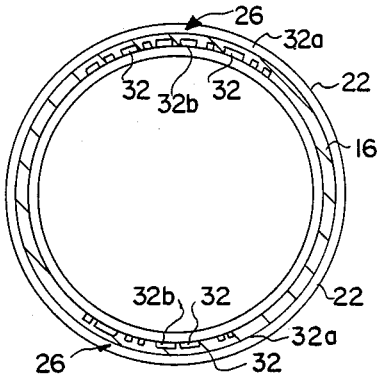
Figure 10:
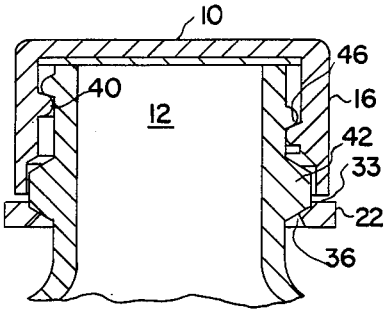
FIG. 10 is a longitudinal sectional view of the assembled cap and bottle of FIG. 1.

FIGS. 6 and 7 show how the recess bottom 32a of the legend 26 can be formed so that they are contiguous thereby enabling the legend 26 to be stretched freely without restraint. This avoids the need for thick portions 38 to provide spacing between legend 26 portions (e.g., letters spelling "opened") and the further need to provide slits in said portions 38 to provide stretchability of the full legend. In this manner, easily recognized legends are produced.

A further advantage of the contiguous legend 26 of FIG. 7 is that their length can be foreshortened by virtue of the absence of letter spacing portions and this provides an opportunity to provide more legends 26 around the cap 10 periphery or perhaps more importantly facilitates molding when the caps 10 are to be stripped off a mold core.

In this embodiment of the invention, moreover, it is to be noted that as the cap 10 is initially twisted into place on the neck finish 12, the stresses which are developed by the interference of projection 36 and locking ring 42 generally are compressive and, therefore, will not cause a color change in the recess bottoms 32a of legend 26. In addition, the capping fixture, one embodiment of which is described hereinafter (FIGS. 20 to 22) may optionally support the rim 22 during capping to assure that it does not buckle skirt 16, particularly in the area of legends 26 as a result of such interference.

As stated previously, the cap 10 of FIGS. 1 to 10 is formed by injection molding and has been conditioned after molding to temperatures below that which cause distortion. It has been found that exposure of caps 10 made of polypropylene copolymer to temperatures of 275° F. for period of 30 minutes up to about 320° F. for less than two minutes enhances the stress whitenability of the legends 26 dramatically.

It has also been found that temperature conditioning in the ranges which enhance stress-whitenability also greatly enhance the ability of the interconnecting portion 35 to tear readily once a tear has been initiated. For example, polypropylene caps having a 0.010 inch-thick interconnecting web shaped portion had such extensibility and strength as molded that they would not be readily broken but simply stretched beyond desirable limits before tearing. However, conditioning to temperatures of 275° F. for 30 minutes to 320° F. for less than 2 minutes dramatically reduced the extensibility and strength so that such thin web shapes could be readily torn once a tear was initiated.

Moreover, the fracture line comprising the interconnecting web 35, may or may not have serrations, slits or gaps therein. In the practice of the invention, it is contemplated that where slits or the like are provided, the interconnecting web portions generally have a breadth or circumferential length about equal to the corresponding breadth of the legend and generally are located directly under the legend. In doing so, the axial stress developed by the cap and container interfering means is directly applied to the legend area to insure the desired color change. In the illustrative embodiment shown in FIGS. 1 to 10, the lengths represent a substantial portion of the periphery, e.g., about 1.70 to about 1.75 inches, and the two slits typically each have a relatively short length of about 0.10 to about 0.20 inches. The foregoing illustration is for what is commonly known as a 28 mm cap having a circumference of about 3.70 inches.

Figure 11:
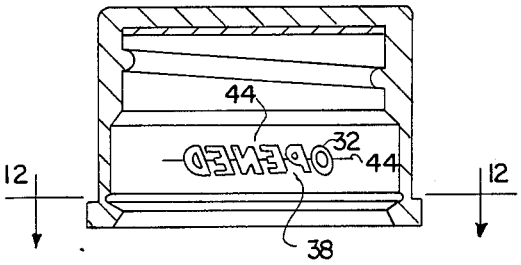
FIG. 11 is a longitudinal sectional view of another embodiment of the cap of the invention.
Figure 12:
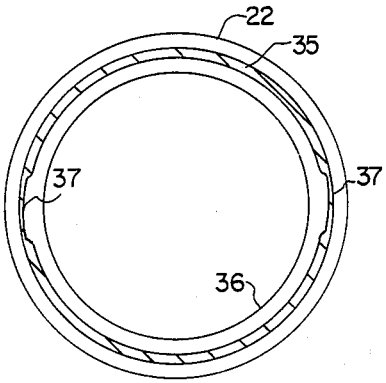
FIG. 12 is a cross-sectional view of the cap of FIG. 11, taken along the lines 12—12 thereof, wherein the interconnecting portion between the cap skirt and ring includes thinner, weakened segments.

Referring now to FIGS. 11 to 12, there is shown another embodiment of propagators for the caps 10 which produce significant savings in mold and molding costs. In this embodiment, segments 37 of reduced thickness are provided in the interconnecting portion or web 35. As in the previous embodiment, the tensile stresses created in removing the cap 10 act to whiten and create the legend 26 while initiating a tear in weakened segments 36 which propagate along the interconnecting web portion or fracture line 35 until the rim 22 is completely severed from cap 10 and retained on the neck 12 by the interference between the internal cap projection 36 and the external locking ring 42.

In this embodiment, the legend portion of the skirt 16 includes interconnecting slots 44 to allow all portions of the area of the legend 26 to stretch freely regardless of its shape by making it possible for the thick sections 38 to move freely without whitening except in the localized slots 34 which will not materially intrude on the graphics of the legend. As shown, the slots 34 are transverse and generally positioned between the closest elements of adjacent letters. The number of slots 34 between adjacent letters and the total number of such slots 34, is selected for each legend to maximize opacification of the thin sections 32a without opacification of the thick sections 38. As also shown, slots 34 can extend on either side of or beyond the legend 26 to facilitate relative movement between the thin and thick portions.

Figure 13:
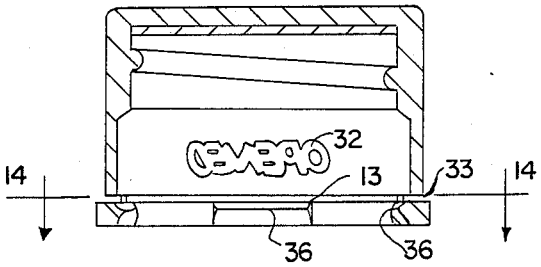
FIG. 13 is a longitudinal sectional view of still another embodiment of the cap of the invention.
Figure 14:
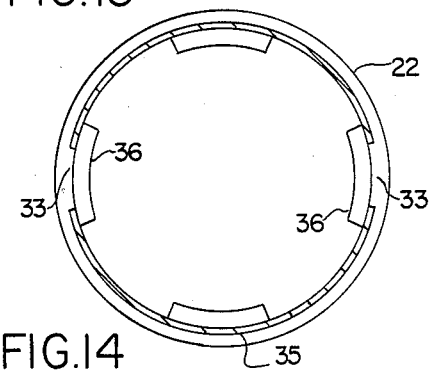
FIG. 14 is a cross-sectional view of FIG. 13, taken along the lines 14—14 thereof, wherein internal projections with gaps therebetween are used to control tear propagation.

FIGS. 13 and 14 illustrate an embodiment of the invention, wherein propagation of the slits 33 in the cap 10 of FIGS. 1 to 10 can be deterred to assure the complete stretching and whitening of legend 26 before the cap 10 is separated from rim 22 by the interference of its projection 36 with locking ring 42. In this case, the projection 36 is interrupted with spaces or gaps 31 to form projections 36a under the legend 26 areas and projections 36b under the slits 33 so that tear propagation in the segments 35a in the interconnecting connection 35 above the gaps 31 must wait until sufficient stress is developed therein from the interference engagement of projections 36b with locking ring 42.

Figure 15:
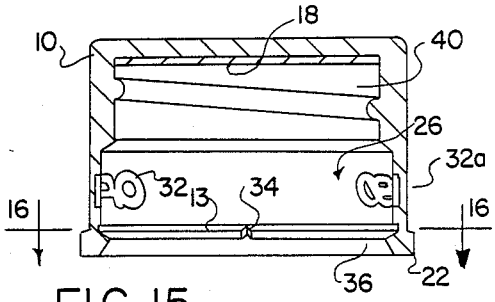
FIG. 15 is a longitudinal sectional view of a still another cap of the invention having internal protrusions or projections which initiate slits in the interconnecting portion between the cap and the rim.
Figure 17:
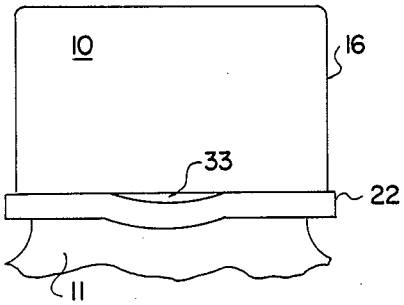
FIG. 17 is an elevational view of the cap of FIG. 15 on a bottle, wherein the slits (only one shown) are produced as the cap is being removed.
Figure 16:
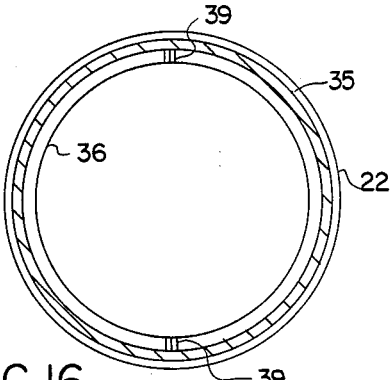
FIG. 16 is a cross-sectional view of FIG. 15, taken along the lines 16—16 thereof.

FIGS. 15 to 17 illustrates how slits 33 can be formed in the interconnecting portion 35 of the cap 10 of FIGS. 1 to 10 during the first stage of cap removal to initiate and facilitate tear progression with significant savings in mold and molding cost. In this embodiment, opposing internal protrusions 39 are placed on the upper surface of projection 36 intermediate the legend 26 areas. All of the early stress from the interference between projection 36 and locking ring 42 therefore will be concentrated above the protrusions 39 to rupture the interconnecting portion 35, thereby providing slits 33 for tear initiation and progression during the remainder of the removal operation. In doing so, the protrusions 39 provide a continuous separation mechanism which further facilitates the propagation of tearing and the separation of the rim 22. Specifically, FIG. 17 shows the formation of slits 33 (only one shown) as the cap twist off procedure is initiated.

Figure 18:
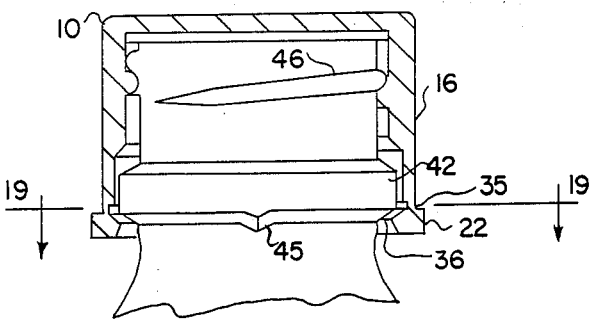
FIG. 18 is a longitudinal sectional view of still another cap and bottle of the invention wherein the bottle has protrusions or projections which initiate slits in and sequentially applies stress to the interconnecting portion between the cap and the rim.
Figure 19:
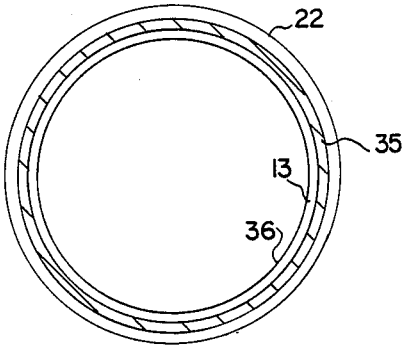
FIG. 19 is a cross-sectional view of FIG. 18 taken along the lines 19—19 thereof.

In FIGS. 18 and 19 there is shown a bottle locking ring 42 which develops a point by point application of stress to the cap projection 36, skirt 16 and interconnecting portion 35 by placing a protrusion 45 on the lower surface of locking ring 42. In this manner, as the cap 10 is twisted off, its projection 36 engages locking ring 42 preferentially at protrusion 45 and maximum axial stress in the cap 10 moves around the cap periphery where and as the protrusion 45 is engaged. The cap 10 in this embodiment has an interconnecting web 35 spaced around its periphery between opposing slits 33 and as the cap 10 is twisted off, the axial stress developed to rupture the web portion 35 is moved sequentially from portion to portion as they pass over the protrusion 45 so that build up of axial stress along web 35 is sequential and removal torques are lowered.

Figure 20:
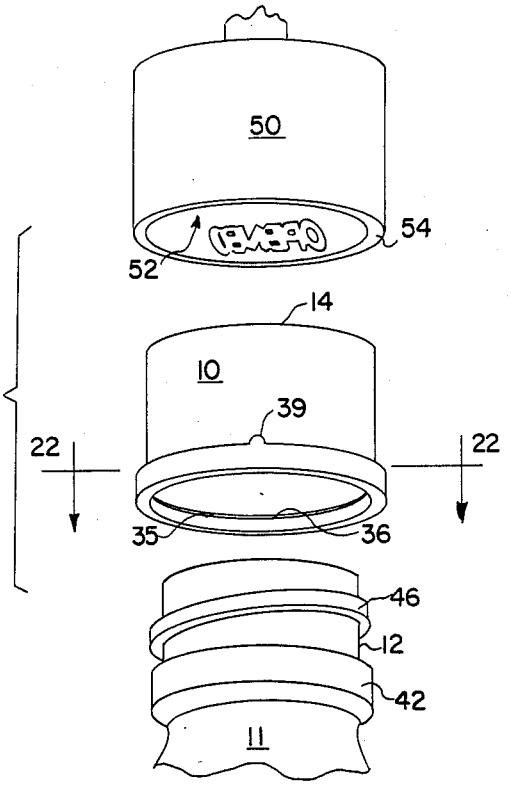
FIG. 20 is an exploded view of one system for producing slits in a cap of the invention which includes the engagement of a capping fixture with the external projection on the rim of a cap of the invention as it is being assembled on the bottle.
Figure 21:
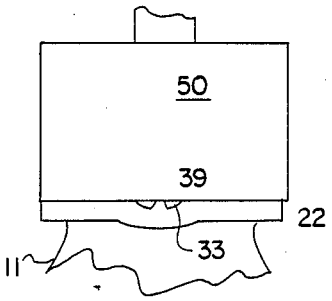
FIG. 21 is a longitudinal view of the assembled system of FIG. 20 illustrating the production of slits (only one shown) in the cap.
Figure 22:
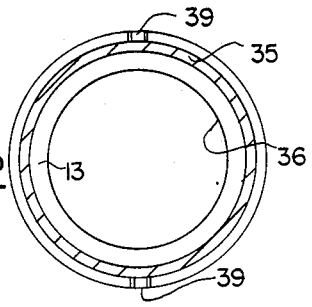
FIG. 22 is a cross-sectional view of the cap shown in FIG. 20 taken along the lines 22—22 thereof.

FIGS. 20 to 22 illustrate another way to form slits 33 in the interconnecting portion 35, but in this embodiment, prior to cap removal. Here, opposing protrusions 39 are placed externally on the upper surface of rim 22 intermediate the legend areas. A capping fixture 50 is provided which is adapted in its axial and radial dimensions to fit over the cap 10 with its upper recess portion 52 abutting the lid portion 14 of the cap 10 and its lower rim portion 54 abutting the top surface of cap rim 22 during the capping operation. In this manner, external protrusions 39 are forced downwardly in respect to other cap portions and the segment of thin interconnecting portion 35 just above the protrusions 39 are ruptured to form a slit suitable for tear initiation on cap removal without the use of costly molds, molding cycles or post molding secondary operations.

Figure 20A:
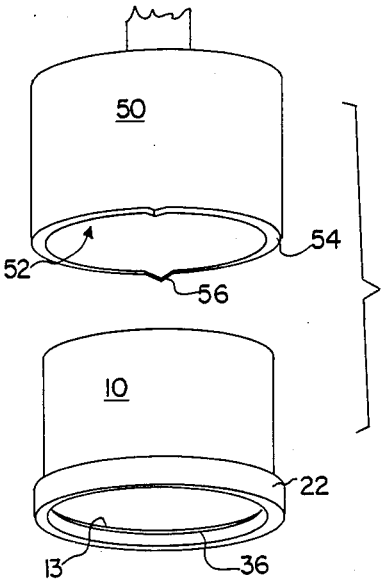
FIG. 20A illustrates a capping fixture with depending projections for producing the tear initiating slits in the cap.

In the embodiment of the invention shown in FIG. 20A, the slit producing projections 56 are depending from the capping fixture 50. In this instance, the fixture projection or protrusions 56 initially force segments of the rim 22 downwardly to produce the slits 33 in the interconnecting web 35.

Figure 23:
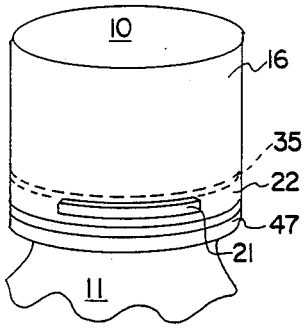
FIG. 23 is a perspective view of another cap of the invention having a pair of opposing external projections (only one shown) which can be engaged to produce a slit in the interconnecting portion of the skirt.
Figure 24:
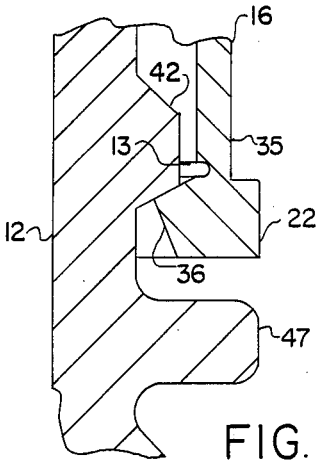
FIG. 24 is an enlarged detailed view, in section, of the cap of FIG. 21 assembled on a bottle (partially shown) having an annular limiting ring which can be used in producing the slits in the cap.

FIGS. 23 and 24 illustrate another means of practicing the tear initiation portion of the invention by replacing the rim 22 of the cap 10 of FIGS. 18 and 19 with opposing projections 21 (only one shown). Also, the bottle neck 12 has been modified to include an annular ring 47 which acts as a stop for the downward movement of projection 21 caused by the application of a capping fixture 50 to the cap 10 (FIG. 20). In this manner, the normal capping operation is able to create slits 33 in the interconnecting portion 35 just above the projections 21 and the extent of the slits 33 is determined by the limits imposed by the projection ring 47 as opposed to the upper recess portion 52 of capping fixture 50.

Figure 23A:
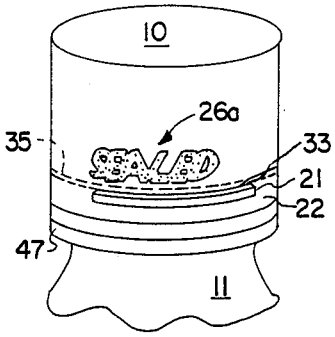
FIG. 23A is a perspective view of the cap of FIG. 23 with the legend "SEALED produced above and formed when the slits are formed.
Figure 23B:
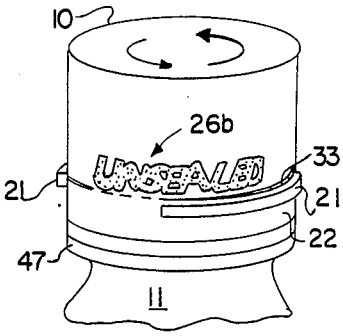
FIG. 23B is a perspective view of the cap of FIG. 23A with the legend UN formed alongside the legend SEALED as the cap is initially removed.

In the embodiment shown in FIGS. 23A and 23B, one legend 26*a* is presented prior to opening (SEALED) and another legend 26*b* is presented after the initial opening (UNSEALED). In FIG. 23A, the cap 10 is placed on the bottle 11 and the projection 21 is moved downwardly and the projection 21 is moved downwardly to produce the slit 33. In doing so, the thin sections 23A defining SEALED are stretched and opacify producing the SEALED legend. Then, upon initial removal of the cap 10, the adjacent thin sections 23A defining "UN" are stretched and opacify as previously described to produce the legend UNSEALED (FIG. 23B). Additional embodiments of changing legends are disclosed in my previously identified copending application (Ser. No. 467,791, filed Feb. 18, 1983) which has been incorporated herein by reference thereto.

Figure 25:
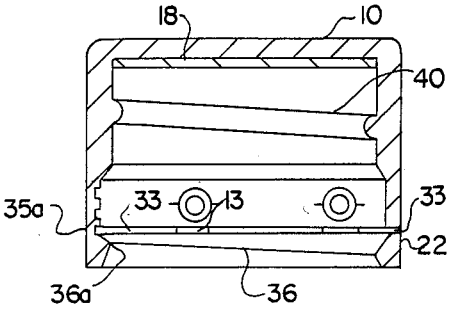
FIG. 25 is a longitudinal sectional view of still another cap of the invention having a biased or slanted projection which initiates slits in and sequentially applies stress to the intermediate portion between the cap and the rim.

FIG. 25 shows how the cap of FIGS. 18 to 19 may be modified to develop the point by point application of stress to the periphery of the cap 10 without the modifying protrusion 45 on the lower surface of locking ring 42 (not shown). In this embodiment, the cap projection 36 is beveled or slanted so that the first engagement with the bottle locking ring 42 occurs at segment 36*a* on cap projection 36 so that the axial stress generated by cap removal is first applied to segment 35*a* of interconnecting portion 35 which lies closely above segment 36*a*. As the cap is rotated, segment 35*a* stretches preferentially and breaks while the stress builds up in the trailing segments of portion 35 in sequence followed by their sequential rupture and final separation of the cap 10 from rim portion 22 which is retained by the bottle neck. In this manner, the build up of axial stress in all of portion 35 simultaneously is avoided and maximum removal torques are lowered.

Further, in this embodiment, the indicia to indicate the package has been opened is the letter "O". As shown, the interconnecting web portions 35 are relatively short being located just directly under each of the eight "O"s (only four shown). In this instance, typical web lengths can be about 0.375 inches and typical slit lengths can be about 0.75 inches.

Figure 25A:
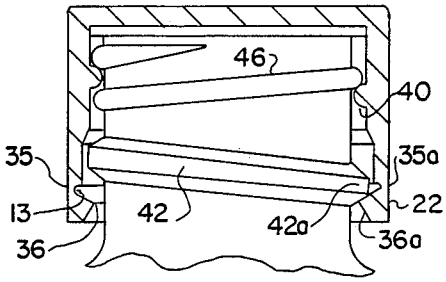
FIG. 25A is a perspective view of the invention wherein the locking ring is beveled or slanted.

FIG. 25A shows how the bottle neck of FIGS. 18 to 19 may be modified to develop the point by point application of stress to the periphery of cap 10 without the modifying protrusion 45 on the lower surface of locking ring 42. In this embodiment, the locking ring 42 is beveled or slanted so that the first engagement with the cap projection 36 occurs at segment 42A on the locking ring 42 causing the axial stress generated by cap removal to be first applied to the segment 35A of the interconnecting portion 35 which lies closely above segment 36A of the cap projection 36. As the cap is rotated, stress does not immediately build up in segment 35A because of the bevel of locking 42, and it will not until it arrives at the downward position of the bevel of locking ring 42. Axial stress does build up in trailing segments to segment 35A as they approach the low point 42A of beveled locking ring 42 so that the localized axial stress on interconnecting portion 35 is maximized when projection 36 is engaged with segment 42A and this maximum point of stress increases as the cap is rotated until rupture and tear of interconnecting portion 35 is completed.

Figure 26:
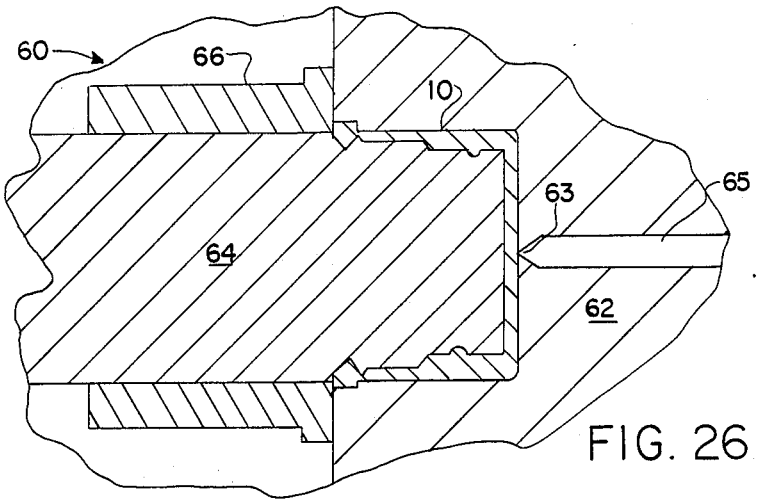
Figure 27:
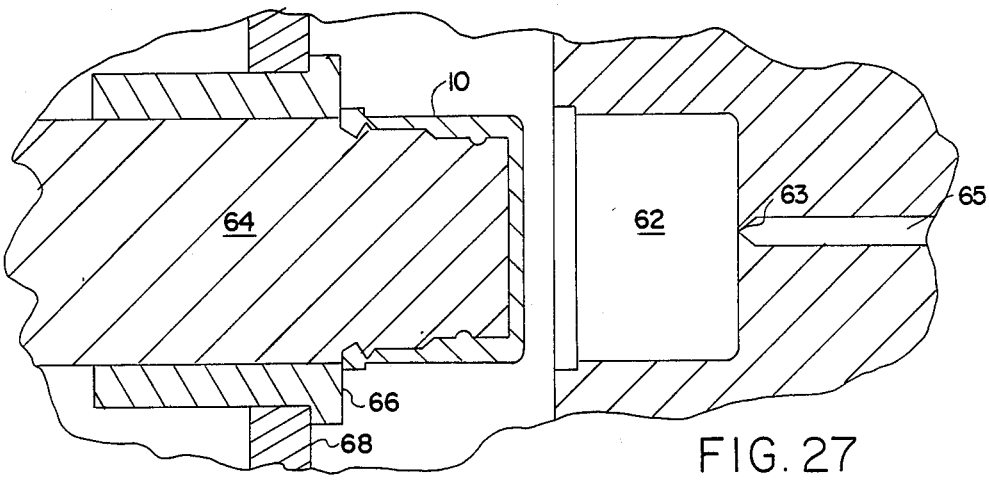
Figure 28:
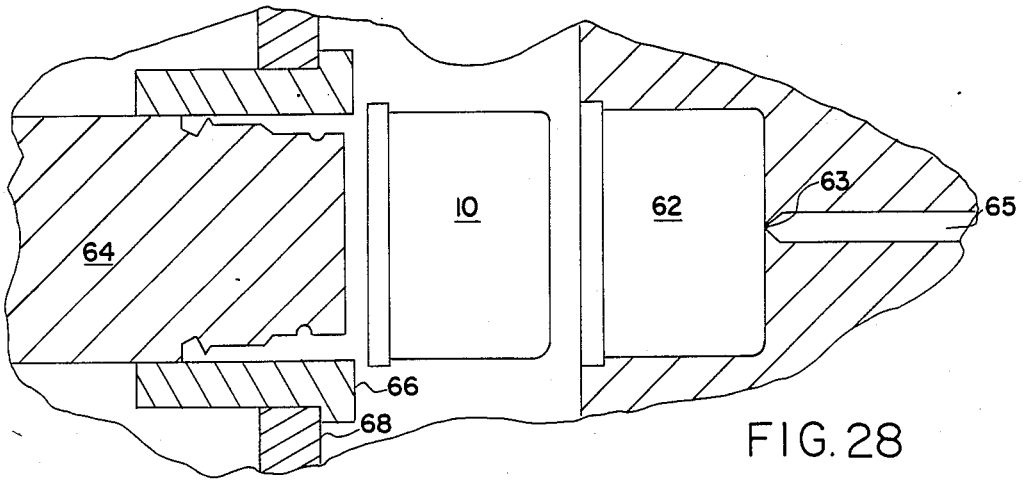

In FIGS. 26 to 28, there is shown a preferred method for production of the cap 10 in an injection mold 60 having a cavity 62, a core 64, a stripper ring 66 and a stripper plate 68. Plastic melt for forming the cap 10 is introduced to the cavity 62 through the runner 65 and the gate 63. The melt forms around the core 64 and hardens as a result of low mold temperatures. Pressure of the plastic melt above 2000 psi and mold temperatures not greater than 200° F. and preferably less than 160° F. for polyolefin and 140° F. for styrenic polymers are suitable for the practice of the invention. Molding cycles obtained thereby are optimally under 20 seconds and preferably under 15 seconds. After the cap 10 is sufficiently set up, the core 64 portion of the mold is withdrawn from the cavity 62 portion while the molded cap 10 is retained on the core 64 due to the undercuts of threads 40 and projection 36. When the cap 10 is clear of cavity 62, the stripper ring 66 is engaged by the stripper plate 68 and pushes cap 10 off core 64 as it continues to withdraw from cavity 62. The cap 10 is then free to drop onto conveyors for removal from the injection molding.

In the practice of the present invention, it is desirable for interconnecting portion 35 to be as strong as possible, it therefore is desirable to achieve the most effective means to rupture such portion. It has been found that a most effective means employs a means whereby the axial stress generated by cap rotation is applied to such portion in a sequential, progressive manner, thereby avoiding the stress build up and rupture of the entire portion 35 simultaneously. In a fracture line or web, the axial stress is zero where slits are initiated and increase at other location as the cap is removed, but the progressive loss of the interconnective portion through the tearing mechanism imposes a subtractive element which imposes a limit to the maximum overall axial stress and removal torque. Because the use of a tearing mechanism for achieving the separation of cap 10 portions is thusly advantageous, the methods of the invention to initiate the tearing action effectively and at low cost are significant.

In addition, where protrusions, e.g., 39, or slanted rings, e.g., 36 or 42, or gaps 31, are used in concert with horizontally disposed rings and the like, an axial spreading component is added to the tensile stress component applied at the point of tear. This separating or spreading mechanism can significantly lower the forces required to accomplish separation of the interconnecting portion 35.

Figure 29:
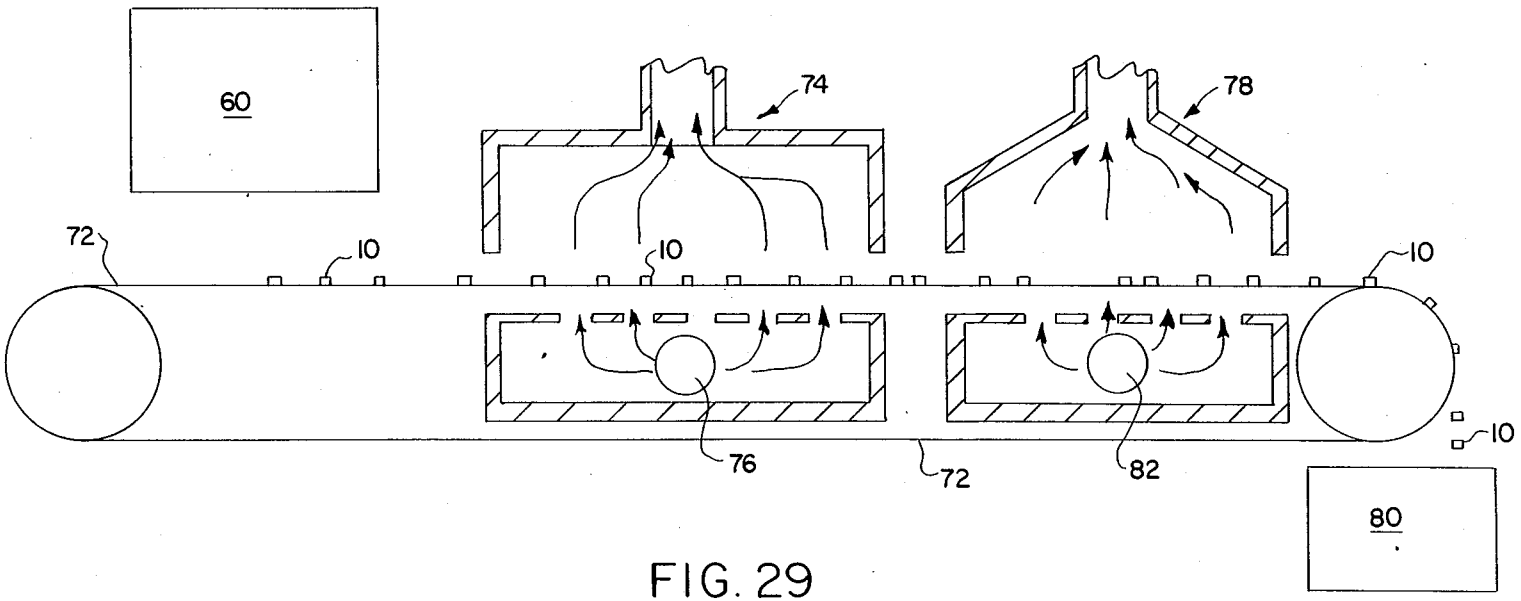
FIG. 29 is a schematic view of one system for heat treating the caps of the invention.

In FIG. 29 there is shown a method for heat conditioning the caps 10 and achieving the described advantages. The cap 10 is dropped from the mold 60 onto a continuous belt conveyor 72 whereon they are carried through a heating chamber 74 which is heated by forced hot air from the blower 76 that is circulated through the chamber 74 as shown by the arrows. The conveyor 72 then progresses to a cool down chamber 78 where the caps 10 are cooled to a temperature low enough for packing in shipping container 80. The temperature within the heating chamber 74 may range from 275° F. to about 320° F. and the transit time of the caps 10 therethrough may range from about 1 to 30 minutes. In addition, other heat sources may be used, such as infra red or other radiation means. The cooling chamber 78 can use forced cooling air from the blower 82 which may contain high levels of moisture injected by atomizers or other means to enhance heat removal from the caps 10.

It has been found that heat treatment of the cap 10 under the conditions noted impairs the integrity of the thin cap interconnecting portion 35 so that its elongation to break is reduced by about 35 to 80% thereby facilitating the tearing and rupturing of such portions. It has also been determined that such treatment significantly increases the stress whitenability of the stretchable, thin legend areas.

The stress whitening or opacifying plastic of the invention can be selected from a group of transparent or opaque polymers which, when stretched, develop an increased opacity which masks the color of any substrate and/or washes out the intensity of any colorant dispersed throughout. In general, when such a plastic is the single component of a cap, the unstressed color selected will be of medium to dark shades and the stressed portions thereof will show up as an off-white color of the same tint as the darker background color. When such a plastic is used as a top strate of a non stress-whitening substrate, it may be transparent or colored as the substrate so that before stretching it is not noticeable, but when stretched, it will show up as white against the unstretched background color which desirably is darker. When it is desired to obliterate a portion of a legend describing the precondition of the bottle to express its new condition, such a plastic used as a top strate (e.g., a printed coating) may be a dark shade whose opacified or whitened color upon stretching matches the color of the surrounding substrate which is lighter. Other colors and color combinations may be desired and used which complement and practice the invention.

Useful plastics for accomplishing the stress whitening of the invention include such polymer blends as elastomer modified polymethylmethacrylates, polystyrenes, styrene-acrylonitrile polymers (e.g., acrylonitrile-butadient-styrene polymers), polypropylenes, polyethylenes and other mult-phase plastics wherein stretching produces phase separation and resultant light diffraction and opacification.

With respect to polypropylene copolymers, we have discovered that in the thin legend 26 sections stress whitenability is enhanced by conditioning the caps 10 to elevated temperatures ranging from 30 minutes at 275° F. to 2 minutes at 320° F.

When the color change which produces the legend of the invention is based on a dispersion of microencapsulated coloring agents, said agents may be dyes, solutions of dyes or reactants which when contacting similarly dispersed chemicals in the plastic matrix form a colored product. The encapsulating shell for the color agent may be of a variety of polymeric materials including gelatins and synthetic polymers. The shells may be precipitated onto the inner colorant as a gelatin as taught by U.S. Pat. Nos. 2,183,053, 2,800,457 and 2,800,458. Or the shells may result from the reaction of water soluble materials such as urea formaldehyde prepolymer in the presence of an emulsified colorant as taught in U.S. Pat. Nos. 3,935,960 and 3,516,846. The matrix for the encapsulated colorant should have sufficient strength to be able to transform the tensile stress imposed on it into a compressive force on the capsules sufficient to crush them. Such high modulus plastics as polypropylene, high density polyethylene, elastomer modified and unmodified polystyrenes and acrylics and other polymers are generally suitable.

The cap of the invention may be fabricated by a variety of molding methods, including injection molding, compression molding, transfer molding, forging and stamping. (See *Modern Plastics Encyclopedia,* Vol. 56, Number 10A, 1979, pages 252–256, 308–331, 345–347 and 410–415.

With respect to the caps of the present invention, they can be used with a full range of molded continuous or discontinuous threaded neck finishes. These caps may also be of one-piece construction consisting of both top and skirt or of a plurality of components including at least a top or lid and a skirt which may be separate or engaged with said top or lid.

The caps of the present invention may be used to close a wide range of containers including narrow neck bottles, wide mouth jars, bags with molded necks, carboys, drums, etc., which may contain a wide variety of liquid and dry products including:

beverages, such as soft drinks, beer, fruit juices and drinks, milk, liquor and wine;

medicinal and health products, such as oral antiseptics, antacids, cough remedies, etc.;

food such as ketchup, vinegar, edible oils, mayonnaise and other pickled or processed foods; and toiletries and cosmetics, such as hair and skin care products.

Also, the disclosure of my copending United States Application (Attorney Docket No. 706-013), entitled TAMPER EVIDENT CLOSURES AND PACKAGES WITH SEPARABLE PORTIONS ON THE CLOSURES AND METHOD OF FORMING THE SAME, and being filed simultaneously herewith and assigned to the assignee of the present invention, is hereby incorporated by reference.

The invention in its broader aspects is not limited to the specific described embodiments and departures may be made therefrom within the scope of the accompanying claims without departing from the principles of the invention and without sacrificing its chief advantages.

I claim:

1. A tamper evident resealable closure for closing, opening and reclosing a package, including a stretchable portion which effects a change in color when stretched, and a separable portion thereon for mechanically coacting with the package to stretch said stretchable portion to effect a change in color which indicates the condition of the package and to effect separation of said separable portion from said closure while said closure with its change in color continues to be available for closing and opening the package.

2. The closure of claim 1, wherein said stretchable portion comprises a plastic which changes color upon being stretched.

3. A tamper evident closure for a container having an opening for dispensing its contents, comprising a resealable cap having a skirt adapted to extend about the periphery of the container for closing, opening and reclosing thereof, means integral with said skirt which comprise plastic and which change color upon stretching, and a separable portion on said skirt which mechanically engages the container about its opening to stretch and effect a color change in said means to indicate that the container has been opened and to separate said separable portion from said skirt when said cap is initially removed from the container.

4. A tamper evident closure for a container having an opening for dispensing its contents, comprising:

a resealable plastic twist cap having a skirt adapted to extend about the periphery of the container for closing, opening and reclosing thereof, a thin section in said plastic skirt which preferentially stretches to effect a change in color upon the application of tensile stress thereto as the cap is twisted off and a thicker section in said plastic skirt adjacent said thin section which remains substantially unstretched and does not change color when said thin section is stretched, and a separable portion on said plastic skirt and below said color changing thin section adapted to engage the container about the opening for tensile stressing said thin section to effect the color change and for separating said separable portion from said skirt when the cap is initially twisted off the package.

5. The tamper evident cap of claim 4, wherein said thin section changes color when stretched to indicate the condition of the package.

6. The tamper evident cap of claim 4, wherein said thin section changes color when stretched and serves as background for said thick section which indicates the condition of the package.

7. The tamper evident cap of claim 4, wherein said thin section has a coating thereon which changes color when stretched by the stretching of said underlying thin section to indicate the condition of the package.

8. The tamper evident cap of claim 4, wherein said thin section has a coating thereon which defines a legend that changes color when stretched by stretching of said underlying thin section to indicate the condition of the package.

9. A resealable tamper evident twist cap for closing, opening and reclosing a container having an externally threaded neck finish, wherein the cap is adapted to change color to indicate the condition of the container, comprising:

a skirt of plastic with an internally threaded upper portion for twisting onto and from the externally threaded neck finish to close, open and reclose the container;

at least one internal recess in said plastic skirt below said threaded portion which forms a thin section and which preferentially stretches upon the application of tensile stress thereto to effect a color change in said skirt, a separable portion on and about said skirt below said internal recess for coacting with the container to tensile stress and effect a color change in said thin section, and an interconnecting portion between and connecting said skirt and separable portion for imparting the color changing tensile stress to said thin section and for separating said separable portion from said skirt at a relatively low cap removal torque when the cap is initially twisted off the container, to thereby indicate the condition of the container.

10. The tamper evident cap of claim 9, wherein there are a plurality of said thinner section which define a legend that stress whiten upon stretching to indicate the condition of the package.

11. The tamper evident cap of claim 10, wherein said thin sections define a legend which upon stretching indicates that the container has been opened, and wherein said separable portion is a ring which coacts with a ring on the neck finish of the container to stretch said thinner sections to produce the legend as said cap is removed.

12. The tamper evident cap of claim 11, wherein said thin sections also define a legend which upon stretching indicates the container is closed, and wherein said ring stretches said legend as said cap is initially applied to indicate the container is closed.

13. The tamper evident cap of claim 10, wherein said thin sections define a legend which upon sequential stretching indicate that said cap is closed and that thereafter it has been opened, and wherein said separable portion is a rim adapted to sequentially stretch said legend and separate from said skirt to indicate the condition of the container.

14. The tamper evident cap of claim 10, wherein said thin sections are biased away from the direction of the stress applied thereto to facilitate stretching.

15. The tamper evident cap of claim 9, wherein a coating is on said thin sections which will change color when stretched and which will stretch with said underlying thin sections.

16. The tamper evident cap of claim 15, wherein said coating stress whitens.

17. The tamper evident cap of claim 15, wherein said coating includes an encapsulated coloring agent, the encapsulation of which will rupture upon stretching to release the agent and effect the color change.

18. A tamper evident twist cap for closing, opening and reclosing a container and for indicating the condition of the container, comprising:

a top and a depending annular skirt of plastic including an upper portion having at least one internal recess therein which forms a thin section and which stretches upon the application of tensile stress thereto to effect a color change in said skirt, a lower separable portion below said internal recess for engaging the container to preferentially stretch and effect a color change in said thin section, and an interconnecting web portion connecting and forming a line of fracture between said upper and lower portions having a tear initiator circumferentially spaced from said thin section for initiating and propagating tearing in said web portion at a relatively low cap removal torque wherein, upon initial twist off of the cap, the engagement between said separable portion and the container tensile stresses said thin sections to effect the color change and tear said web portion to separate said lower separable portion from said upper skirt, and thereby indicate the condition of the container.

19. The tamper evident cap of claim 18, wherein the axial stress is minimal at said tear initiator of said interconnecting portion and is initially relatively high in said web portion as the cap is removed.

20. The tamper evident cap of claim 19, wherein the tearing of said interconnecting web portion is progressive and thereby lessens the amount of axial stress required for tearing and thereby reduces the maximum overall axial stress and removal torque.

21. The tamper evident cap of claim 18, wherein said tear initiator is a slit.

22. The tamper evident cap of claim 18, wherein said tear initiator is a section in said interconnecting web of reduced thickness relative to the thickness of the remainder of said web.

23. The tamper evident cap of claim 18, wherein said separable portion has an inner projection which initially engages the container to produce stress and rupture in said interconnecting web portion which forms a tear initiating slit therein.

24. The tamper evident cap and container of claim 18, wherein the container has a projection thereon which initially engages said lower separable portion to produce stress and rupture in said interconnecting web portion which forms a tear initiating slit therein.

25. The tamper evident cap of claim 18, wherein the cap has projection means thereon which concurrently stresses a segment of said interconnecting web portion away from said thin section to produce a rupture therein which forms a tear initiating slit therein and stresses the segment of said interconnecting web portion beneath said thin section to effect the color change therein while the segment of said interconnecting portion between said tear initiating segments and color changing segment has a reduced level of stress.

26. The tamper evident cap of claim 18, wherein said tear initiator is a slit in said web portion, and wherein said separable portion has an internal projection for engaging the container beneath said slit and thin section in said skirt with a gap therebetween to retard tear propagation in the interconnecting web portion thereabove.

27. The tamper evident cap of claim 18, wherein said separable portion is an external rim having a projection thereon for preferential stretching and rupturing said interconnecting portion adjacent thereto to form a tear initiating slit in said web portion.

28. The tamper evident cap of claim 27, wherein means are provided which engage said projection as the cap is being initially placed on a container to produce said tear initiating slit.

29. The tamper evident plastic cap of claim 18, wherein said thin section stress whitens when stretched, and wherein the cap is heat treated to enhance said stress whitening.

30. The tamper evident cap of claim 18, wherein the cap is heat treated to reduce the elongation of said interconnecting web portion and enhance tearability.

31. A heat treated tamper evident plastic twist cap for closing, opening and reclosing a container having an externally threaded neck finish with a ring therebelow, wherein cap is adapted to indicate the condition of the container, comprising:

a top and a depending annular skirt of plastic including an upper portion having an internally threaded portion for twisting onto and from the externally threaded neck finish, at least one internal recess therein below said threads which forms a thin section and which preferentially stretches and stress whitens upon the application of tensile stress thereto to effect a color change in said skirt, and a thicker section contiguous to said thinner section which remains substantially unstretched and does not stress whiten when tensile stress is applied to said thinner section, a lower separable rim below said internal recess having an internal projection for engaging the ring on the neck finish for preferentially stretching and effecting a color change in said thin section, and an internal groove in said skirt between said rim and skirt forming a thin interconnecting tear line where, upon initial twist off removal of the cap, the engagement between said projection and the rim tensile stresses said thin section to effect the color change therein and separate said rim from said skirt along said tear line and at a relatively low cap removal torque, to thereby indicate the condition of the container.

32. The heat treated tamper evident plastic twist cap of claim 31, wherein the heat treatment of the cap reduces elongation to break and enhances tearability along said interconnecting tear line.

33. The heat treated tamper evident plastic twist cap of claim 31, wherein the heat treatment of the cap enhances stress whitening of said thin section when tensile stress is applied thereto.

34. The heat treated tamper evident plastic twist cap of claim 31, wherein there are a plurality of said thin and thick sections in said skirt adjacent to one another, and wherein slots are provided therebetween to facilitate uniform stretching and stress whitening of said thin sections.

35. The heat treated tamper evident plastic twist cap of claim 31, wherein there are a plurality of said thin and thick sections in said skirt adjacent to one another, and wherein said thin sections are interconnected by contiguous segments therebetween to form a legible, stress whitened contiguous legend when said thin sections are tensile stressed.

36. A heat treated tamper evident plastic cap for closing, opening and reclosing a bottle, and for indicating the condition of the bottle, comprising:

a top and a depending annular skirt of plastic including an upper portion having internal recesses therebelow which form opposing thin sections and which preferentially stretch upon the application of tensile stress thereto to effect a color change in said skirt, a lower tearaway ring below said internal recesses for engaging the bottle for preferentially stretching and effecting a color change in said thin sections, and a thin interconnecting portion between said skirt portion and lower rim a having web directly beneath said thinner sections connecting said skirt to said rim and tear initiators in said web and between said thin sections wherein, upon initial twist off removal of the cap, the engagement between said ring and the container tensile stresses said web portions and said thin sections to effect a color change in said thin sections and at relatively low cap removal torques propagate tears in said web portions beginning at said tear initiators to separate said rim from said skirt, to thereby indicate the condition of the container, and wherein the removal torque is relatively low because the tensile stress is minimal at said tear initiators and lessens in said interconnecting web portions as the tears propagate therein, and because heat treatment reduces elongation to break and thereby enhances tearability.

37. The tamper evident cap of claim 36, wherein said tear initiators are slits.

38. The tamper evident cap of claim 36, wherein said tear initiators are sections in said interconnecting web of reduced thickness relative to the thickness of said web.

39. The tamper evident cap of claim 36, wherein said ring has projection on its periphery which initially engages the container to produce stress and rupture in said interconnecting web to form tear initiating slits therein.

40. The tamper evident cap and container of claim 36, wherein the container has projections thereon which initially engage said ring to produce stress and rupture in said web which form tear initiating slits therein.

41. The tamper evident cap of claim 36, wherein the cap has projection means thereon which concurrently stress segments of said interconnecting web circumferentially away from said thin sections in said skirt to produce a rupture therein which form tear initiating slits therein and stress in the segments of said interconnecting web directly beneath said thin sections to effect the color change therein while the segments of said web between said tear initiating and color changing segments have a reduced level of stress.

42. The tamper evident cap of claim 36, wherein said tear initiators are slits, and wherein said ring has an internal projection for engaging the container beneath said slits and thin sections with gaps therebetween to retard tear propagation in the interconnecting web segments thereabove.

43. The tamper evident cap of claim 42, wherein capping means are provided to initially place the cap on the container and engage said projections on said rim to, produce said tear initiating slits.

44. The tamper evident cap of claim 36, wherein said ring is an external rim which has projections thereon for preferential stretching and rupturing said interconnecting web adjacent thereto to form tear initiating slits therein.

45. The tamper evident plastic cap of claim 36, wherein said thin sections stress whiten when stretched, and wherein the cap is heat treated to enhance said stress whitening.

46. The tamper evident cap of claim 36, wherein said container or cap includes projections for preferentially moving segments of said ring to produce stress and rupture in said web which form tear initiating. slits therein, and the container includes a ring thereon which limits the preferential movement of said ring.

47. The tamper evident cap of claim 36, wherein said skirt includes slots therein which interconnect said thin and thick sections for facilitating relative movement therebetween when said thin sections are tensile stressed to effect a color change in said skirt.

48. The tamper evident cap of claim 36, wherein said thin sections have contiguous segments for facilitating a color change in said skirt when said thin sections are tensile stressed.

49. A method of forming a heat treated, molded plastic cap, comprising:

molding a plastic cap having a skirt with a color changing portion, a separable portion below the color changing portion, and an interconnecting portion connecting the separable portion to the body of the skirt, wherein the color changing and interconnecting portion is adapted to be tensile stressed to effect the color change and separation of the separable portion, and heat treating the cap prior to application to the container to reduce the elongation to break of the interconnecting portion to facilitate separation of the separable portion from the body of the cap.

50. A method of forming a heat treated, molded plastic cap, comprising:

molding a plastic cap having a skirt with a stress whitening portion, a separable portion below the stress whitening portion, and an interconnecting portion connecting the separable portion to the skirt, wherein the stress whitening and interconnecting portion is adapted to be tensile stressed to effect stress whitening and separation of the separable portion, heat treating the cap prior to application the container to reduce the elongation to break of the interconnecting portion to facilitate separation of the separable portion from the body of the cap, and producing slits in the interconnecting portion in placing the cap on the container to further facilitate subsequent separation of the separable portion from the body of the skirt when the interconnecting portion is tensile stressed.

51. The method of claim 50, wherein the interconnecting portion is a web directly under the stress whitening portion and having a circumferential length which is greater than the circumferential length of the stress whitening portion, and wherein the slits are formed in the web away from the stress whitening portion in placing the cap on the container.

52. The method of claims 49 or 50, wherein the interconnecting portion is formed by an internal groove between the body of the skirt and the separable portion, and wherein the interconnecting portion is thinner in cross-sectional dimension than the body of the skirt and the separable portion.

53. The method of claims 49 or 50, wherein the separable portion is a ring or a rim.

54. The method of claims 49 or 50, wherein the interconnecting portion is a web which at least extends directly beneath the color changing or stress whitening portion.

55. The method of claims 49 or 50, wherein the interconnecting portion is thinner in cross-sectional dimension than the body of the skirt and the separable portion.

56. A method of producing tear initiators in a molded plastic cap having a skirt with a color changing portion, a separable portion below the color changing portion, and an interconnecting web portion connecting the separable portion to the body of the skirt, wherein the color changing and interconnecting portions are adapted to be tensile stressed to effect the color change and separation of the separable portion, comprising:

producing a tear indicating slit in the interconnecting portion circumferentially away from the color changing portion when placing the cap on the container to facilitate subsequent separation of the separable portion when the interconnecting portion is tensile stressed.

57. The method of producing tear initiators in a molded plastic cap of claim 45, wherein the cap has a projection thereon adjacent the interconnecting portion of the web, and engaging the projection during capping to preferentially tensile stress and slit the adjacent interconnecting web portion.

58. The method of producing tear initiators in a molded plastic cap of claim 56, wherein the capping means has a projection thereon for engaging the cap and preferentially tensile stressing adjacent segments of the interconnecting portion to produce a slit therein.

59. A method of producing tear initiators in a molded plastic cap having a skirt with a color changing portion, a separable portion below the color changing portion, and an interconnecting portion connecting the separable portion to the body of the skirt, wherein the color changing and interconnecting portions are adapted to be tensile stressed to effect the color change and separation of the separable portion, comprising:

placing the cap on the container wherein the interconnecting portion is free of tear initiators therein, and preferentially tensile stressing the interconnecting portion to produce a tear initiating L slit therein as the cap is initially removed from the container to facilitate separation of the separable portion.

60. The method of producing tear initiators in the cap of claim 59, wherein the preferentially tensile stressing is done by means on the cap or container.

* * * * *